United States Patent [19]

Porth et al.

[11] 4,115,957

[45] Sep. 26, 1978

[54] BELT CENTERING AND REPLACEMENT MECHANISM FOR BELT SANDERS AND THE LIKE

[75] Inventors: Chris H. Porth, Palatine; E. Harold Lilja, Arlington Heights, both of Ill.

[73] Assignee: Skil Corporation, Chicago, Ill.

[21] Appl. No.: 837,470

[22] Filed: Sep. 28, 1977

[51] Int. Cl.[2] ..... B24B 21/18; B24B 23/06

[52] U.S. Cl. ..... 51/170 EB; 51/148

[58] Field of Search ..... 51/170 EB, 148, 170 R

[56] References Cited

U.S. PATENT DOCUMENTS

| | | | |
|---|---|---|---|
| 2,565,223 | 8/1951 | Gentzel | 51/170 EB |
| 2,686,392 | 8/1954 | Moore | 51/170 EB |
| 3,429,078 | 2/1969 | Beckering | 51/170 R |

*Primary Examiner*—Harold D. Whitehead
*Assistant Examiner*—Roscoe V. Parker
*Attorney, Agent, or Firm*—Clarence J. Fleming

[57] ABSTRACT

The front idler roller of the belt sander is mounted by a yoke for swinging movement in a plane containing the axes of both the drive and idler rollers and for shifting movement along a path generally toward and away from the drive roller. A transversely disposed shaft mounted by the tool housing has a cam formation at one end thereof received within an opening formed in the yoke; the cam is captured in this opening formed in part by a cam follower. The shaft is mounted for axial and rotational movements. Rotation of a first knob on the other end of the shaft causes the latter to move axially thereby to swing the idler roller for centering of the belt. Rotation of a second knob, concentric with the first knob and also mounted on other other end of the shaft, causes the shaft to rotate thereby activating the cam for shifting the idler roller toward the rear roller for easy belt replacement.

10 Claims, 4 Drawing Figures

BELT CENTERING AND REPLACEMENT MECHANISM FOR BELT SANDERS AND THE LIKE

BACKGROUND OF THE INVENTION

1. Field of the Invention

The present invention relates to abrading, burnishing and polishing machines, such as belt sanders, for example. More particularly, the invention relates to a belt centering and replacement mechanism for such devices.

2. The Prior Art

Belt centering and replacement mechanisms of the general type here under consideration are known in the prior art. Representative patents showing such devices are: Gentzel U.S. Pat. No. 2,565,22; Moore U.S. Pat. No. 2,686,392; and Beckering U.S. Pat No. 3,429,078. These prior art devices are handicapped for a number of reasons. In particular, these prior devices are of rather complicated construction thus resulting in increased expense, both in material cost and in assembly. Additionally, these prior devices, because of their complexity, are likely to malfunction. Moreover, the complexity of these prior art devices adds significantly to the weight of these small hand-held tools which is very undesirable.

SUMMARY AND OBJECTS OF THE PRESENT INVENTION

A unitary control member is operable in two modes for achieving both belt centering and belt replacement. Concentric knobs compactly mounted on one end of the control member permits the operator to rotate a selected knob for achieving belt centering or belt replacement.

A primary object of the present invention is the provision of a new and improved belt centering and belt replacement mechanism for a belt sander or the like, which mechanism includes a single control member operable in two different modes for achieving the belt centering and belt replacement functions.

Another object of the present invention is the provision of a mechanism of the type descibed wherein the control member comprises a single shaft operated in two different modes by concentric knobs mounted on the shaft.

Still another object of the present invention is the provision of a mechanism of the type described including a cam which shifts a yoke (supporting the idler roller) for belt replacement purposes when the cam is rotated, which cam is captured within an opening in the yoke thereby also serving to swing the yoke for belt centering purposes when the cam is moved transversely.

These and other objects and advantages of the present invention will become apparent from the following specification disclosing a preferred embodiment shown in the accompanying drawings.

DESCRIPTION OF THE PREFERRED EMBODIMENT

Figure 1:
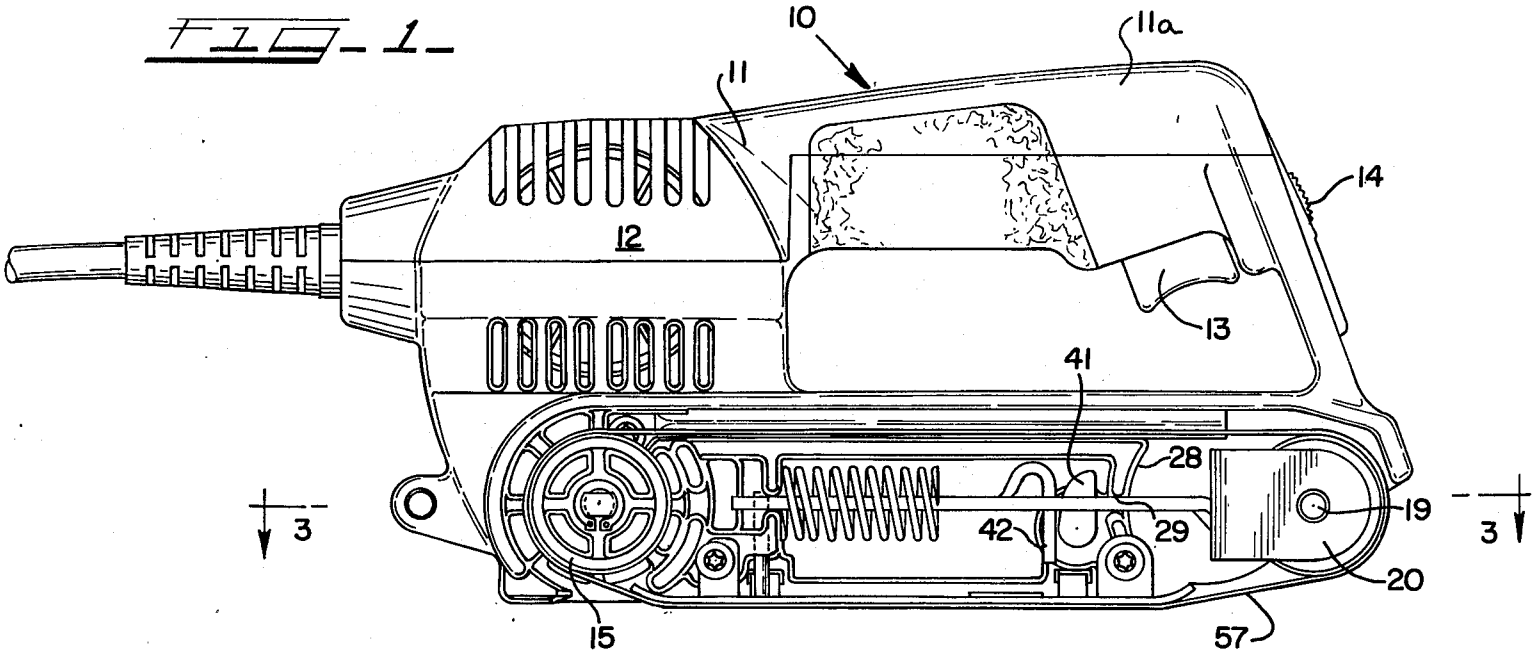
FIG. 1 is a side elevational view of a belt sander embodying the present invention.

Referring to FIG. 1, a portable belt sander, generally designated 10, includes a housing 11 which may be of the clamshell-type. The housing includes a compartment or chamber 12 enclosing an electric motor under the control of a trigger 13 which may be locked in the full "on" position by a locking button 14. The trigger and locking button are suitably mounted in a housing handle portion 11*a*.

Figure 3:
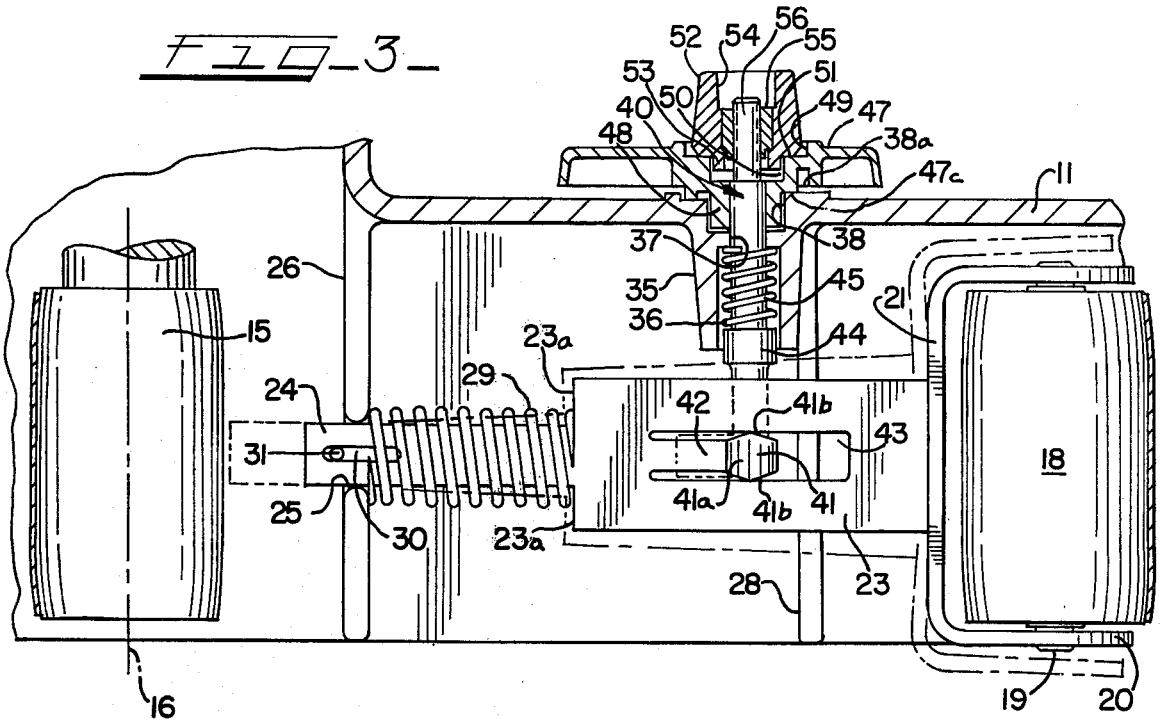
FIG. 3 is a section taken along the line 3—3 of FIG. 1, but with the belt being removed.
Figure 4:
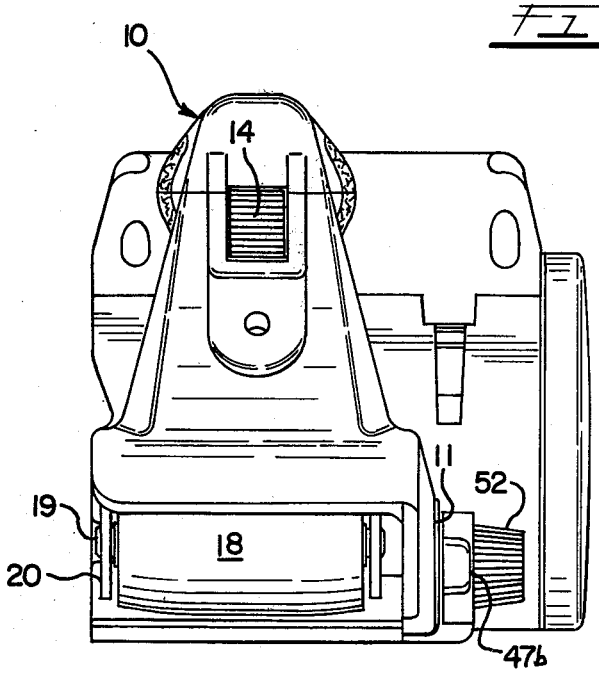
FIG. 4 is a front elevational view of the belt sander, again showing the same without the belt.

The electric motor is connected, by appropriate gearing or by a drive belt, to a drive roller 15, the latter being journaled in the tool housing. It will be understood that the roller 15 is driven, upon energization of the electric motor, for rotation about a fixed transverse axis 16 (FIG. 3).

The portable belt sander 10 includes an idler roller 18 mounted for rotation on a shaft 19. Opposite ends of the shaft are received within apertures formed in the arms 20 of a U-shaped member including a bight portion 21. The bight portion 21 is secured to one end of a plate 23; this plate and the U-shaped member just described form a yoke for mounting the front idler roller 18. The plate 23 is integral with a stem portion 24, the distal end of which is received within an opening 25 formed in a transverse housing wall 26. It will be understood that the stem 24 is loosely received within the opening 25 such that the front roller 18 may swing (as indicated by the phantom lines in FIG. 3) in a plane containing the axes of rotation of the roller 18 and the drive roller 15.

As noted in FIG. 1, the housing includes another generally transverse wall 28 defining a slot 29 which receives the plates 23 thereby supporting the latter for shifting or swinging movement in the plane which contains the axes of rotation of the rollers 15 and 18. Thus, the roller 18 is supported by the yoke including the plate 23 for shifting movement to and away from the rear rollers and for swinging movement from side to side.

A coil spring 29 encircles the stem 24. One end of the spring abuts shoulders 23*a* of the plate 23. The other end of the spring abuts the wall 26 around the opening 25. The stem 24 includes a longitudinally extending slot 30 mounting a stop pin 31. It will be apparent that the spring 29 acts to urge the front roller outwardly, or to the right as seen in FIGS. 1 and 3; movement of the front roller in this direction is limited by engagement of opposite ends of the pin 31 with the plate 26. It will also be apparent that the spring 29 constantly urges the roller 18 outwardly or away from the rear drive roller.

The housing 11 includes an integral cylindrical formation 35 having a first bore 36 communicating with a reduced-in-diameter bore 37. The side wall of the housing 11 includes a bore 38 communicating with the bore 37.

A control shaft, generally designated 40, is mounted for both rotational and axial movements in the bores 36, 37 and 38. The shaft 40 includes a cam formation 41 on the inner end thereof. This cam includes a cam surface 41*a* engaged with a cam follower 42 in the form of a tongue struck from the plate 23 and defining, in part, an opening 43 in the plate 23. The cam formation 41 has side walls 41*b* engaging side surfaces of the opening 43. Thus, the cam 41 is in effect captured within this opening in the plate 23.

The shaft 40 includes an enlarged annular formation 44 defining a shoulder engaged by one end of a coil spring 45. The other end of this coil spring engages the annular shoulder formed by the juncture of bores 36, 37.

A first operating member or knob 47 is suitably keyed or splined to the shaft 40. The knob 47 includes a boss 48 rotatably received within the housing bore 38. The knob 47 is preferably formed with wing-like extensions 47*a* , 47*b* (FIG. 2) to facilitate rotation of the knob. Of course, rotation of the knob causes corresponding rotation of the shaft 40 because of the key or spline connection.

The knob 47 includes a first bore 49 communicating with a reduced-in-diameter bore 50 thereby defining an annular shoulder 51. A second knob or operating member 52 has a portion thereof received within the opening 49; this knob has a reduced-in-diameter portion 53 received within the bore 50 of the knob 47. The knob 52 includes a central bore 54 in which is secured a nut 55, the latter being threadingly engaged with a threaded portion 56 of the shaft 40. It will be apparent that the spring 45 acts to urge the shaft 40 inwardly with the annular shoulder 51 on the knob 47 in engagement with the shoulder on the knob 52 formed adjacent the reduced-in-diameter portion 53. This spring action also maintains an annular surface 47*c* on the knob 47 in engagement with an annular surface 38*a* at the mouth of the opening 38.

Figure 2:
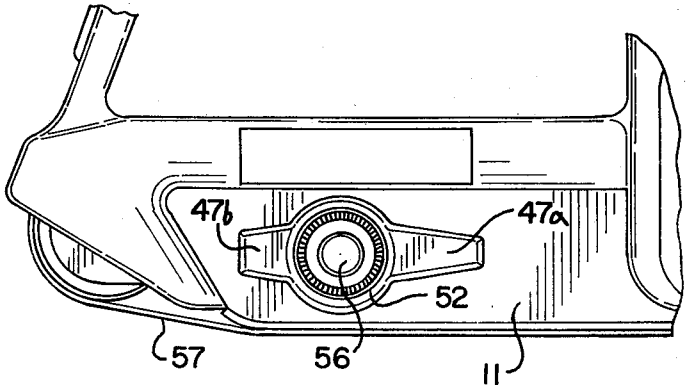
FIG. 2 is a fragmentary elevational view of the other side of the belt sander primarily showing the concentric knobs for controlling the belt centering and belt replacement mechanism.

Rotation of the knob 47 to its maximum position (clockwise as seen in FIG. 2) will impart corresponding rotation to the shaft 40. This rotary movement will in turn impart swinging movement to the cam 41 thereby to urge the plate 23 and front roller 18 inwardly toward the rear drive roller against the force of the coil spring 29. Upon inward movement of the front roller 18, the latter is then locked in place for replacement of a belt 57 of the portable belt sander. Return movement or release of the knob 47 will permit the spring 29 to force the idler roller 18 forwardly for holding the belt 57 in a taut condition.

Rotation of the knob 52 will impart axial movement to the shaft 40 by reason of the threaded connection between the nut 55 and the threaded shaft portion 56. The direction of axial movement is of course dependent upon the direction in which the knob 52 is rotated. This axial movement of the shaft 40 will impart swinging movement to the yoke which is defined by the U-shaped member 19, 20 and the plate 23. This swinging movement is brought about by engagement of the cam formations 41*b* with the side edges of the opening 43 in the plate 23. This swinging movement of the yoke causes corresponding swinging movement of the roller 18 in a plane containing the axes of rotation of the rollers 18 and 15. Such movement of the idler roller serves to center the belt 57 for tracking purposes.

Thus, it will be seen that the present invention provides a very compact belt centering and belt replacement mechanism for a belt sander or the like. A single control member, viz., the transversely disposed shaft 40, is moveable in two different modes, i.e., both rotationally and axially, for achieving movements of the front idler roller 18 for belt replacement and belt centering purposes, respectively. These movements to the control shaft 40 are brought about by the operation of the concentrically mounted knobs 47 and 52 which are also concentric with the shaft 40. The compact arrangement of the present invention is further facilitated by nesting a portion of the knob 52 within a recess formed in the knob 47. This construction minimizes the distance the operating knobs protrude from the exterior of the housing 11. This compact design is even further facilitated by the fact that both knobs 47, 52 perform their functions by rotational movement and thus need not be moved axially to and away from the tool housing.

We claim:

1. In a belt-type abrading, burnishing or polishing device of the type having a housing, a driving motor, drive and idler rollers rotatable about generally parallel axes, wherein the drive roller is driven by said motor, and a belt entrained over said drive and idler rollers, the improved belt centering and replacement mechanism comprising:

(a) mounting means supporting said idler roller from said housing for swinging movement in a plane containing the axes of both of the drive and idler rollers and for shifting movement along a path generally toward and away from the drive roller;

(b) a control member mounted by said housing for compound movement in first and second different modes;

(c) first means connecting said control member with said mounting means such that movement of the control member in said first mode causes swinging movement to the mounting means;

(d) second means connecting said control member with said mounting means such that movement of the control member in said second mode imparts shifting movement of the mounting means for moving said idler roller toward said drive roller;

(e) a manually operated belt centering member connected with said control member for moving the same in said first mode; and (f) a manually operated belt replacement member also connected with said control member for moving the same in said second mode.

2. The mechanism according to claim 1 wherein said control member includes a shaft extending transversely of the housing and mounted thereby for both rotational and axial movements, rotation of the shaft constituting one of said first and second modes and axial movement of the shaft constituting the other of said first and second modes.

3. The mechanism according to claim 1 wherein said belt centering member and said belt replacement member are mounted for rotation only about concentric axes.

4. The mechanism according to claim 1 further defined by:

(a) said control member including a shaft extending transversely of the housing and mounted thereby for both axial movement and rotation thereby constituting said first and second different modes, respectively;

(b) said first means including plural formations on one end of said shaft and engaging said mounting means; and (c) said second means including a cam on said one end of the shaft and engaging said mounting means.

5. The mechanism according to claim 4 wherein said plural formations are defined by surfaces of said cam.

6. The mechanism according to claim 4 wherein said mounting means includes a yoke having an opening defined in part by a cam follower engaged by said cam, said opening also being defined by surfaces engaged with said plural formations.

7. The mechanism according to claim 4 further defined by:

(a) said belt centering member including a first knob mounted for rotation only and being connected with the other end of said shaft thereby to cause axial movement of the latter in response to rotation of said first knob; and (b) said belt replacement member including a second knob mounted for rotation only and being connected with said other end of the shaft thereby to cause rotation of the latter in response to rotation of said second knob.

8. The mechanism according to claim 7 wherein said shaft and said first and second knobs are concentrically disposed, said first knob being threadingly engaged with said shaft and said second knob being fixed on the shaft.

9. The mechanism according to claim 8 wherein one of said knobs includes an annular recess concentric with its axis of rotation and wherein the other knob is nested in part within said recess.

10. The mechanism according to claim 6 further defined by spring means engaged with said yoke for urging said cam follower into engagement with said cam.

* * * * *